US007954433B1

(12) United States Patent
Barnett

(10) Patent No.: US 7,954,433 B1
(45) Date of Patent: Jun. 7, 2011

(54) EXPLOSIVE SHAPED CHARGE DEVICE

(76) Inventor: Matt Bradley Barnett, Columbus, TX (US)

( * ) Notice: Subject to any disclaimer, the term of this patent is extended or adjusted under 35 U.S.C. 154(b) by 192 days.

(21) Appl. No.: 12/460,806

(22) Filed: Jul. 24, 2009

Related U.S. Application Data

(60) Provisional application No. 61/135,973, filed on Jul. 24, 2008.

(51) Int. Cl.
*F42B 1/02* (2006.01)

(52) U.S. Cl. ..... 102/307

(58) Field of Classification Search ..... 102/306–310; 149/76

See application file for complete search history.

(56) References Cited

U.S. PATENT DOCUMENTS

| | | | | | |
|---|---|---|---|---|---|
| 2,407,093 | A | | 9/1946 | Mohaupt | |
| 2,513,233 | A | * | 6/1950 | Byers | 102/306 |
| 2,759,418 | A | * | 8/1956 | Ross et al. | 102/313 |
| 2,892,407 | A | | 6/1959 | MacLeod | |
| 3,217,650 | A | | 11/1965 | Paul | |
| 3,218,975 | A | | 11/1965 | Massey | |
| 3,224,368 | A | | 12/1965 | House | |
| 3,244,102 | A | | 4/1966 | Wofford | |
| 3,462,324 | A | * | 8/1969 | Grant et al. | 149/2 |
| 3,561,361 | A | | 2/1971 | Kessenich | |
| 3,718,512 | A | * | 2/1973 | Hurst | 149/2 |
| 3,722,410 | A | * | 3/1973 | Hurst | 102/315 |
| 3,789,760 | A | * | 2/1974 | Griffith | 102/331 |
| 4,093,478 | A | | 6/1978 | Hurst | |
| 4,099,464 | A | | 7/1978 | Cross et al. | |
| 4,151,798 | A | * | 5/1979 | Ridgeway | 89/1.14 |
| 4,450,768 | A | | 5/1984 | Bell | |
| 4,672,896 | A | | 6/1987 | Precoul et al. | |
| 4,905,601 | A | | 3/1990 | Gabriel et al. | |
| 4,955,939 | A | | 9/1990 | Petrousky et al. | |
| 4,979,443 | A | * | 12/1990 | Rittel et al. | 102/307 |
| 5,221,808 | A | | 6/1993 | Werner et al. | |
| 5,614,692 | A | | 3/1997 | Brown et al. | |
| 5,705,768 | A | | 1/1998 | Ey | |
| 5,792,977 | A | | 8/1998 | Chawia | |
| 5,859,383 | A | | 1/1999 | Davison | |
| 5,902,954 | A | | 5/1999 | Hetz | |
| 5,936,184 | A | * | 8/1999 | Majerus et al. | 89/1.13 |
| 6,386,109 | B1 | | 5/2002 | Brooks | |
| 6,435,096 | B1 | | 8/2002 | Watson | |
| 6,584,908 | B2 | | 7/2003 | Alford | |
| 6,684,791 | B1 | * | 2/2004 | Barnhart | 102/307 |
| 6,983,698 | B1 | | 1/2006 | Walters et al. | |
| 7,546,806 | B1 | * | 6/2009 | Daniels et al. | 102/306 |
| 2002/0129724 | A1 | * | 9/2002 | Clark et al. | 102/307 |
| 2005/0235859 | A1 | * | 10/2005 | Myers et al. | 102/307 |
| 2010/0011945 | A1 | * | 1/2010 | Loehr | 89/1.151 |

* cited by examiner

*Primary Examiner* — Troy Chambers
(74) *Attorney, Agent, or Firm* — Roy Patrick Norris

(57) ABSTRACT

The shaped charge device consists of an outer casing that has a removable cap on one end and a sealing plate on the other as well as an interior liner; the liner defining a plurality of forwardly opening conical cavities. The shaped charge device uses a two-part binary explosive that consists of an inert fuel material and an inert powder material and thereby enjoys the legal freedoms of a binary explosive. The powder material is disposed in the space existing between the liner and the outer casing of the shaped charge device. The conical cavities serve to form and focus the resulting plasma jet when the shaped charge device is detonated. Without the fuel material added, the device can be stored for long periods of time. The cap removed and the fuel material added activates the device and an opening in the cap allows the device to be detonated.

17 Claims, 3 Drawing Sheets

EXPLOSIVE SHAPED CHARGE DEVICE

CROSS-REFERENCE TO RELATED APPLICATIONS

Figure 1A:
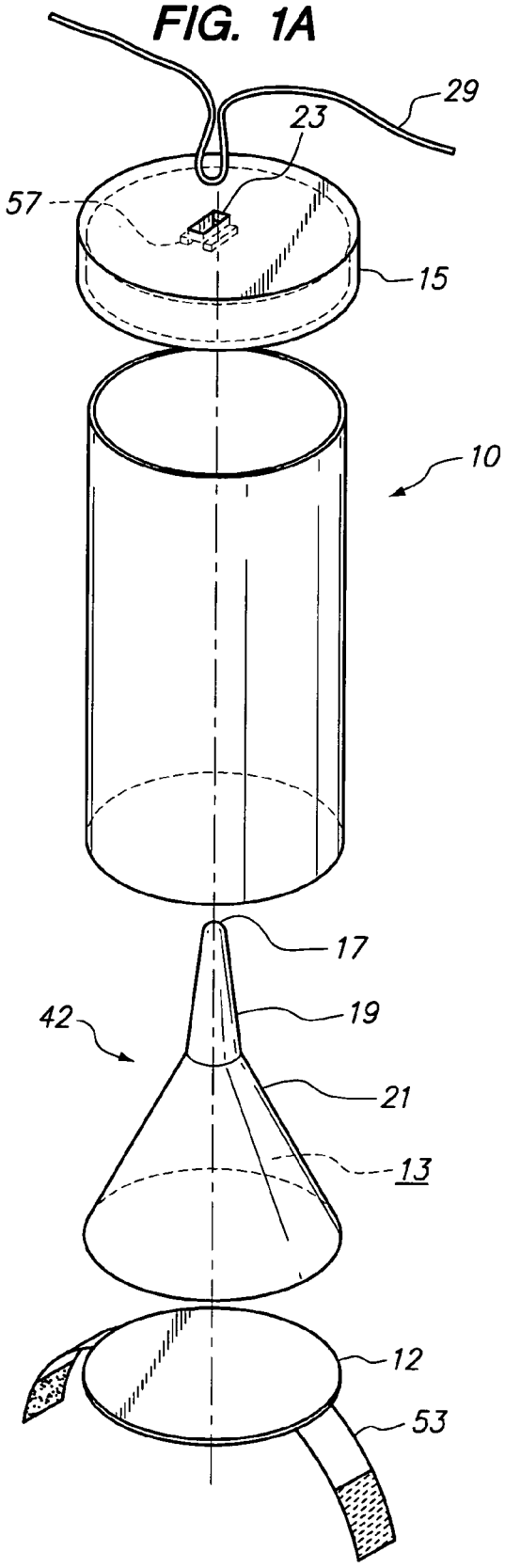

This application claims the benefit of provisional patent application Ser. No. 61/135,973 filed 2008 Jul. 24, by the present inventor, which is incorporated by reference.

FEDERALLY SPONSORED RESEARCH

Not applicable.

SEQUENCE LISTING OR PROGRAM

Not applicable.

BACKGROUND

1. Field of Invention

This invention relates to shaped charge devices that generate plasma jets, specifically to an improved shaped charge that enjoys the legal freedoms of a binary explosive, requires no standoff, does not require a metal cavity liner, easy to activate, can self attach to the designated target, and can be reliably and inexpensively initiated.

2. Prior Art

Relevant prior art includes:

U.S. PATENTS

U.S. Pat. No. 2,892,407—Shaped Cavity Explosive Charge
U.S. Pat. No. 4,450,768—Shaped Charge and Method of Making It
U.S. Pat. No. 4,672,896—Hollow Charges
U.S. Pat. No. 5,221,808—Shaped Charge Liner Including Bismuth
U.S. Pat. No. 5,614,692—Shaped-Charge Device with Progressive Inward Collapsing Jet
U.S. Pat. No. 5,792,977—High Performance Composite Shaped Charge

BACKGROUND OF THE INVENTION

In the Unexploded Ordnance (UXO) field it is often necessary to penetrate very thick metal (1-4 inches). Sometimes, this metal is backed by explosives or concrete producing an even more difficult target. When a projectile such as a 155 mm artillery round requires demolition, it is often necessary to use a shaped charge to penetrate the thick metal of this rather large shell. A shape charge has a cone that is backed with explosive in such a way that upon initiation inverts and sends a molten jet of plasma into the target. Because of this cone, more surface area of the explosive is exposed and more energy is focused on the target in much the same manner a magnifying glass pinpoints sunrays into hot spots capable of easily starting fires. Conventional shape charges are made of metal, are packed with commercial explosives, and require a standoff. The UXO industry has graduated to using oil field perforators for penetrating thick walls of ordnance. The oil field perforators have the advantages of not requiring a standoff and because of their metal casing around the explosive (providing for the prevention of detonation) require a less expensive means of transportation. These shape charges work very well, yet there is room for improvement. They are made of metal and are heavy, thus adding to the cost of shipment. Even though shipping shape charges is cheaper than shipping raw explosives, because of the explosive content the shipping is still higher than that of an inert object of the same weight. These shape charges can reliably penetrate up to 3 inches of steel yet they require expensive 80-grain detonating cord for reliable initiation. The 80-grain detonating cord is awkward to use and is held in place by metal clips that are difficult to manipulate. These charges do not have any built in means for adhesion to the target, a side effect of no UXO specific products. Because of this, the charges must be fixed to targets with tape that is susceptible to the elements and time consuming. The present embodiment creates a shape charge that can be packaged more easily than existing shape charges, more easily shipped, more easily prepared for detonation, and the present embodiment is easily manufactured using inexpensively formed casing, lid, bottom plate, and liner materials such as plastic. Although an application for the UXO field has been developed, this same embodiment can be utilized in many fields where penetration of a material is desired through the use of a shaped charge explosive.

DRAWINGS

Figures

FIGS. 1A-A perspective view of the shaped charge device showing contained therein a first embodiment of the liner.

Figure 1B:
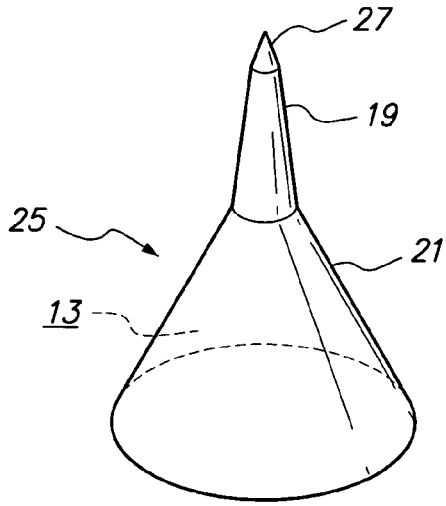

FIGS. 1B-A perspective view of an alternative embodiment of the liner alone.

Figure 2A:
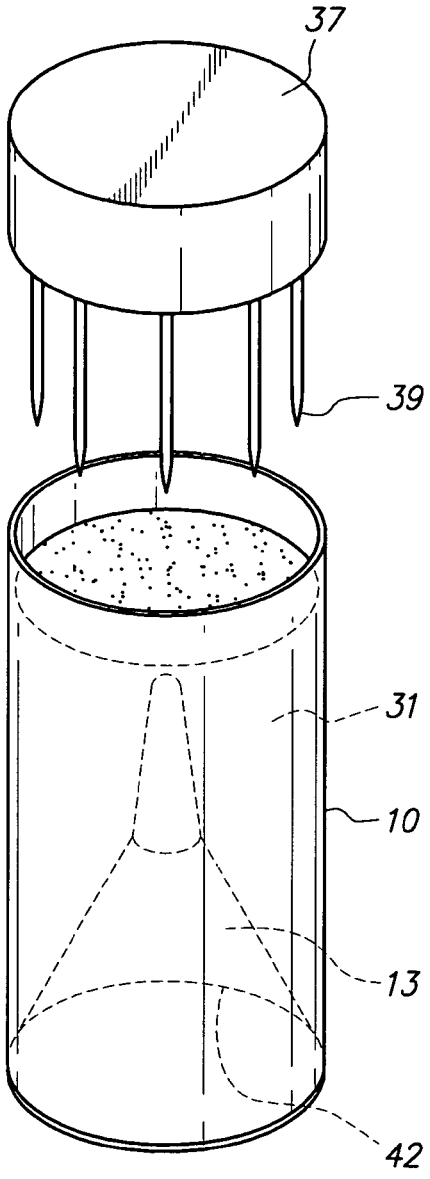

FIGS. 2A-A perspective view of the shaped charge device showing the substantially non-explosive powder material ready to be penetrated by an example fuel cavity penetrative means.

Figure 2B:
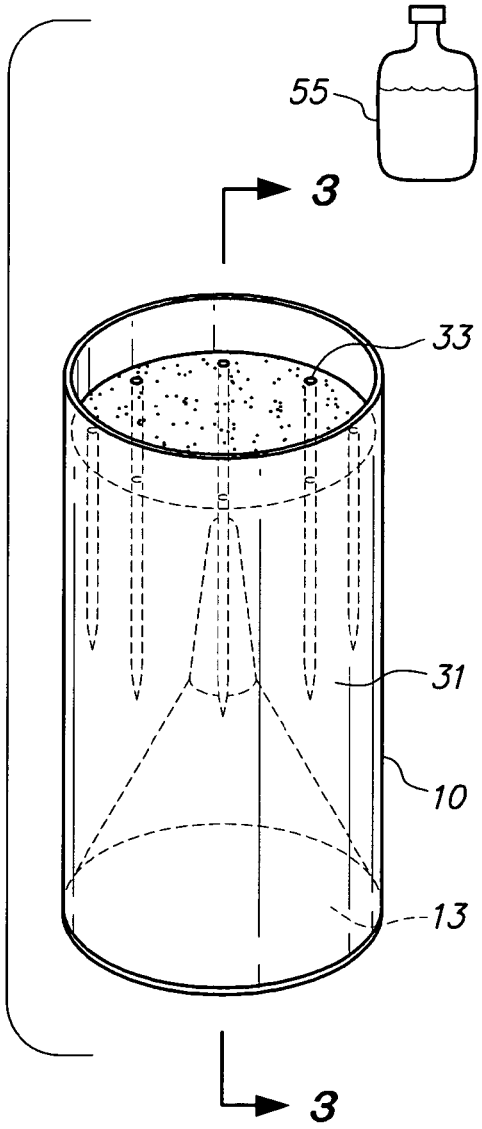

FIGS. 2B-A perspective view of the shaped charge device showing the powder material with the fuel penetrative cavities.

Figure 3:
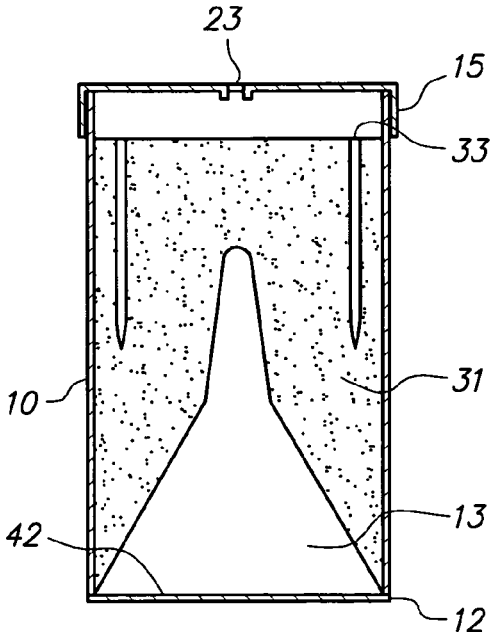

FIG. 3-A perspective view, shown partly broken away, of the assembled shape charge ready for storage or for insertion of the detonating cord.

Figure 4:
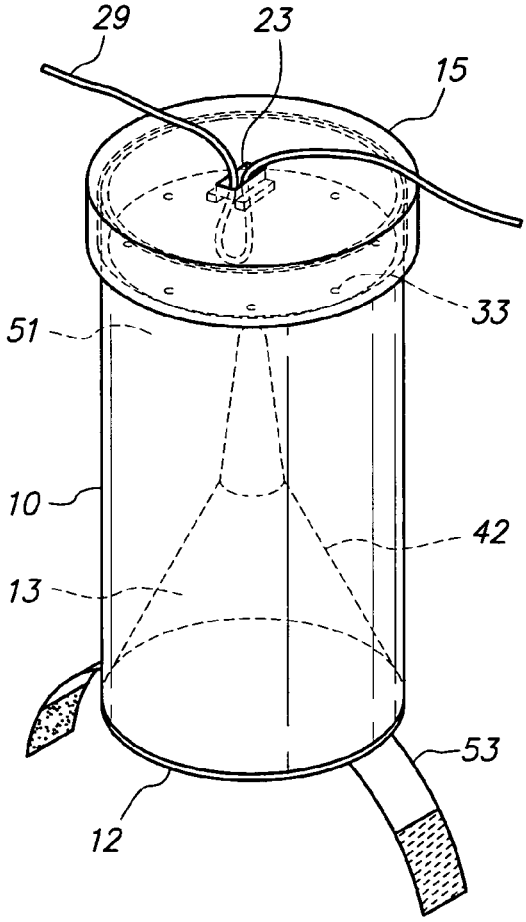

FIG. 4-A perspective view of the assembled shape charge ready to be detonated.

DRAWINGS

List of Reference Numerals

10—casing
12—bottom plate
13—forwardly opening conical cavity
15—removable cap
17—apex of liner with two conical cavities
19—angled surface of first conical cavity
21—angled surface of second conical cavity
23—cap opening
25—alternative embodiment interior liner that defines the conical cavities
27—angled surface of third conical cavity
29—detonation cord
31—substantially non-explosive powder material ingredient
33—penetrative cavity formed in powder material
37—example means for making penetrative cavities into the powder material prior to mixing
39—single protuberance from an example penetrative cavity making means
42—interior liner that defines the conical cavities

51—resulting explosive that is formed by admixing the separate and substantially non-explosive ingredients of powder and fuel

53—attachment means

55—fuel material

57—detonation cord guiding protuberance

DETAILED DESCRIPTION

Each of the components of the first embodiment and alternative embodiments are discussed in general and detail throughout this section. As shown in FIG. 1A, the first embodiment shaped charge device consists of a hollow casing 10 that consists of an upper end and a lower end. Within casing 10 is an attached inner cavity defining liner 42. The liner 42 is of uniform thickness and is shaped to define two forwardly opening conical cavities and is adapted to fit within and not extend beyond said casing 10. A conical cavity 13 is formed by the interior of liner 42 and is closed at its top by an apex 17 and continues through to create the first conical volume as formed by an angled surface 19 and then continues through to create a second conical volume as formed by an angled surface 21. The forward opening of the lowermost portion of conical cavity 13 terminates and attaches at the lower end of casing 10. The lower end of casing 10 is closed at its bottom by an attached bottom plate 12. Attached to bottom plate 12 are an attachment means 53 that affix the shaped charge device to the detonation site material that is to be explosively penetrated. The attachment means 53 can be self-adhesive material affixed to the underside of plate 12, adhesive type extensions or "wings" that are pre-attached to the casing 10 and the bottom plate 12, or self-adhesive type extensions that attach only to casing 10, or self-adhesive type extensions that attach only to bottom plate 12, or that attach to removable cap15, or any combination thereof. There could also be non-self-adhesive type extensions that attach to casing 10 or to bottom plate 12 that merely "tie down" the shaped charge device to the detonation site material. In an embodiment, the self-adhesive "wings" could peel down from the outer casing 10 and then self-adhesively attach to the material slated for explosive penetration, or the "wings" could wrap around the material and then each wing side attach to the opposing wing side. The attachment means could also be via loop and hook type mechanisms, wire twist means, or any other attachment means. Therefore, the wide variety of attachment means for the embodiments have not been shown in the figures.

The upper end of casing 10 is closed with the removable cap 15. The removable cap 15 contains a cap opening 23 sized to allow a detonation cord 29 to be passed through. On the underside of opening 23 is a guiding protuberance 57 that helps guide the detonation cord 29 to a predetermined position within the interior volume of casing 10.

FIG. 1B shows an alternative embodiment liner 25 that is similar to liner 42 and differs in only the shape of the interior cavity 13 that is formed. Liner 25 is shaped to define three forwardly opening conical cavities, instead of only two. Liner 25 is closed at its top and continues through to create a first conical volume as formed by an angled surface 27, continues on to create a second conical volume as formed by the angled surface 19, and then continues onto create a final conical volume as formed by angled surface 21.

In the first embodiment liner 42 as shown in FIG. 1A, the angle of the first conical opening of cavity 13 formed by angled surface 19 is approximately 10 degrees and the angle of the second conical opening formed by the angled surface 21 is approximately 60 degrees. In an alternative embodiment liner 25 as shown in FIG. 1B, the angle of the first conical opening formed by the angled surface 27 is approximately 5 degrees, the angle of the second conical opening formed by angled surface 19 is also approximately 10 degrees, and the angle of the third conical opening formed by angled surface 21 is approximately 60 degrees.

Alternative embodiments not shown can use a variety of conical opening angles between 5 and 90 degrees for the angled surfaces 27, 19, and 21 based upon desired effect of the resulting plasma jet. Referring to FIGS. 1A and 1B, for alternative embodiments not shown, the ranges of the interior angles of the conical cavities comprising the inner surface of the cavity liner 42 as represented by the first angled surface 19, can be between 5 and 90 degrees and the second angled surface 21 can be between 5 and 90 degrees. The relationship between angles of the two conical cavities formed by the first angled surface 19 and the second angled surface 21 is one of compliment or destruction depending on ratios. The bottom portion of conical cavity 13 formed by the angled surface 21 has the main purpose of being a built-in standoff with a secondary purpose of helping form a plasma jet that results in a wider hole in the desired material in certain scenarios. The upper portion of conical cavity 13 formed by the angled surface 19 has the main purpose for penetration and depth of the resulting plasma jet into the material located immediately beneath the underside of bottom plate 12. In the alternative embodiment as shown in FIG. 1B, the top upper portion of the conical cavity 13 formed by the angled surface 27 allows for added penetration of the plasma jet into the material located immediately beneath the underside of bottom plate 12. In the first embodiment and any alternative embodiment, as the conical angle formed by angled surface 21 increases along a spectrum from 5 to 90 degrees, then its function changes from serving as a standoff for a shaped charge device to more of a widening agent for the resulting hole. The angle formed by angled surface 19 depends upon the angle value for angled surface 21. As the value in degrees of the lower angled surface 21 changes, in final assembly, from 5 degrees to 90 degrees, then the value in degrees of the upper angled surface 19 must move from 90 degrees to 5 degrees so as to form a plasma jet that is a useful penetrating agent. The top conical cavity 13 portion formed in the alternative embodiment as shown in FIG. 1B by the angled surface 27 provides fine tuning of the plasma jet that would erupt from the device into the material on the underside of bottom plate 12.

FIG. 2A shows a substantially non-explosive powder material 31 as it resides between casing 10 and the interior liner 42. The liner 42 prevents the powder material 31 from entering the void of conical cavity 13. The FIGS. 2A-2B show an example means of formation of a plurality of penetrative fuel cavities 33 into the powder material 31 that are necessary to admix a fuel material 55 consistently throughout the powder material 31 to form the explosive. An example of a means device 37 for making the penetrative cavities 33 in the powder material 31 is shown. The example means device 37 is lowered into the powder material 31 and then removed leaving behind fuel cavities 33. The fuel cavities 33 are formed by a plurality of protuberances 39 attached to the example means device 37. The fuel cavities 33 are spaced throughout the volume of outer casing 10 but do not penetrate the liner 42 and into the conical cavity 13. The fuel cavities 33 are adapted to admix the fuel material 55 consistently throughout the power material 31.

FIG. 3 shows a perspective view, partially torn away, of an assembled shape charge. The powder material 31 is resident between casing 10 and the liner 42. The fuel cavities 33 are shown formed therein. The volume of cavity 13 as formed by the liner 42 is present. The removable cap 15 is attached to the top of outer casing 10. The bottom plate 12 is attached to the bottom of outer casing 10. A shaped charge in this configuration without the fuel mixture added is in its storage configuration.

FIG. 4 shows a perspective view of a completed shape charge device ready for detonation. The device is comprised of the casing 10 and the liner 42 contained therein, the attached bottom plate 12 seals the conical cavity 13, an explosive material 51 that was formed by admixing the substantially non explosive fuel material 55 (not shown) into the substantially non-explosive powder ingredient 31 (as shown on FIG. 2A), via fuel mixing cavities 33 located therein is present between casing 10 and liner 42, the removable cap 15 is attached, the detonation cord 29 placed through the cap opening 23 and just touching the top surface of the explosive 51, and an example attachment means 53 is present ready to attach the shaped charge device to the material slated to be explosively penetrated.

In all figures, the first embodiment casing 10, cap 15, and bottom plate 12 can be formed from a PVC similar material. The liner 42 or liner 25 is formed of a thin rigid material, including plastic, capable of supporting the weight of the explosive powder without deflection, but not so thick as to significantly impede nor alter the resulting plasma jet. The first embodiment uses PVC pipe type of schedule 40, $3/16^{th}$ inch, and an inner plastic liner of $1/16^{th}$ inch in thickness.

Operation:

The present embodiment assumes the use of an explosive composed of two substantially non-explosive ingredients that, when admixed together, produce an explosive that is ready for detonation via a detonating cord. In the present embodiment, the first ingredient is an ammonium perchlorate powder that is 80% by total weight and the second ingredient is a nitromethane racing fuel that is 20% by total weight, although the present embodiment does not preclude the use of any other variety of substantially non-explosive ingredients or proportions of substantially non-explosive ingredients that when combined together, produce an explosive. Referring to FIGS. 1A-1B, and 2A-2B for the first embodiment shaped charge device that uses a binary explosive, measure out substantially non-explosive powder material 31 and place into the top of the shape charge container volume defined as the area between by casing 10 and liner 42. Enough powder material 31 is used such that after using a loading means, including tamping or the use of a sonic vibrating table, the following is ensured: that the powder material 31 is compressed and evenly distributed throughout the area created by casing 10 and liner 42; that the powder material 31 completely covers the top surface of liner 42; and that the power material 31 rises evenly above liner 42, does not overflow out of the upper end of casing 10, and still resides below the opening 23 when cap 15 is correctly attached.

After the powder 21 has been loaded into the outer casing 10, then referring to FIGS. 2A and 2B, a cavity forming means device 37 is utilized to form the fuel mixing cavities 33 within the power material 31 to create a plurality of cavities 33 that are evenly distributed throughout the explosive powder volume and that extend longitudinally from the top of the powder material 31 down to but not extending through nor touching the liner 42.

Referring to FIG. 2B, after loading the powder material 31 and creating the fuel mixing cavities 33, a heat producing means (not shown) is used to bake the first embodiment to the extent necessary to appropriately harden the powder material 31. For the first embodiment, the baking period is at a temperature of approximately 120 degrees for a time period of more than two days but less than five days.

Referring to FIG. 3, the cap 15 and the bottom plate 12 are attached onto the outer casing 10. The embodiment is ready for use at this point and can be stored, using the first embodiment powder mixture as described herein, for up to one year if stored in a cool, dry, place.

Referring to FIG. 4, when the device is desired to be used, the lid 15 is removed and the appropriate amount of substantially non-explosive fuel material 55 (not shown) is poured into the top of the outer casing 10. The lid 15 is then replaced upon the outer casing 10. The fuel will flow into the penetrative cavities 33 and after an appropriate period of time, will permeate evenly throughout the powdered material 31. As a result of adding the fuel, the two substantially non-explosive ingredients combine to produce an explosive ready for detonation. The shaped charge device is then attached to the surface desired with the attachment means 53. As noted earlier, the attachment means can comprise any attachment means including self-adhesives, adhesive extensions, attached straps, and hook and latch mechanisms.

To activate the device, the detonating cord 29 is placed through the opening 23 in cap 15 and can be looped as shown in FIG. 4 with the necessary length such that the bottom of the detonating cord 29 is just touching the top of the explosive 51. The detonating cord is then activated and the device generates a plasma jet into the material below the device.

Alternative Embodiments

Alternative embodiments, not shown in the FIGS. 1A-1B, utilize a variety of combinations of the conical angles of the liner 42 of between five degrees and ninety degrees for the angled surfaces 19 and 21, to adjust for a deeper, or a wider hole in the resulting material that the device is attached to.

Alternative embodiments utilize easily formed and manufactured materials for the outer casing 10, lid 15, bottom plate 12, and liners 42 and 25 of FIGS. 1A-1B. These materials include PVC, CPVC, Polyesters, Polyamids, Phenolics, Amino resins, Acrylics, Acetals, HDPE, and any plastic material that has the property of rigidity. Alternative embodiments continue to utilize the outer casing 10, lid 15, bottom plate 12, and liners 42 and 25 of FIGS. 1A-1B to generate the desired plasma jet but either utilize alternative combinations of ingredients that comprise binary explosives or the alternative embodiments can also comprise non-binary explosives. Alternative embodiments can utilize another detonation means besides the detonating cord 29 as shown in FIG. 4.

Alternative embodiments can attach the device to the material to be penetrated via a variety of attachment means as shown in FIG. 4.

Alternative embodiments can use any other variety of substantially non-explosive ingredients or proportions of substantially non-explosive ingredients that when combined together, produce an explosive.

Advantages:

The present embodiment may have one or more of the following advantages:

One advantage of the embodiment is that the simple act of pouring in the correct amount of liquid fuel into the outer casing easily activates the device; there is no mixing required because the substantially non-explosive powder ingredient already has fuel mixing cavities present therein that allow the non-explosive fuel ingredient to be evenly dispersed throughout. When the non-explosive powder ingredient and the non-explosive fuel ingredient are admixed, an explosive material is formed that can be detonated at the detonation site. The fuel ingredient can be admixed at the site location and within 15 minutes, the device can be ready to be detonated.

Another advantage of the embodiment is that because of the two lower conical areas formed by an interior liner, no standoff is required. The bottom-most angled surface forms a conical shape that can also serve as a built-in standoff.

Another advantage of the embodiment is that the device uses a two-part binary explosive material (fuel and powder) whose ingredients are themselves substantially non-explosive but when admixed, produce an explosive material. The embodiment, loaded with the powder material, but with none of the fuel material added, enjoys all the legal freedoms of binary explosives and can be shipped, trucked, or mailed easily to the site location.

Another advantage of the first embodiment is that the device can be inexpensively detonated. Many different detonation type devices can be used but one can also use an 18-grain detonating cord instead of the much more expensive 80-grain detonating cord. Further, the opening in the cap eliminates the need for other detonation attachment devices such as, but not limited to, awkward detonation cord clips that can bent or be lost.

Another advantage of the embodiment is that the device can be attached to the desired surface that requires explosive penetration via an attachment means, such as an adhesive, applied to the bottom of the device, or self adhesive wings or extensions already attached to the device along the sides and/or sides and bottom, that thusly eliminating the need for separate straps or tape.

Another advantage of the embodiment is that the lid, outer casing and the inner liner help protect the substantially non-explosive powder ingredient from the elements and the bottom plate protects the cavity that formed by the inner liner from being contaminated with foreign debris.

Another advantage of the embodiment it is not sensitive to bullet impact and yet is reliably set off by 18 grain detonation cord.

Another advantage of the embodiment is that this binary explosive mix in this configuration has brisance enough to produce the sizeable holes in the skin of a variety of solid surfaces, including metal, barrels, mines, and artillery rounds, such as but not limited to a 155 mm artillery round.

Another advantage of the embodiment is that it does not require a stand-off and does not require a metallic cavity liner.

I claim:

1. A shaped charge device comprising:

(a) a casing;

(b) an inner liner of uniform thickness shaped to define a plurality of forwardly opening conical cavities and adapted to fit within said casing and thereby form a space between said liner and an inner wall of said casing, wherein said conical cavities are in linear axial alignment of one another, to thereby form concentric plasma jets, wherein the uppermost conical cavity has a closed apex near an upper end of said casing and the lowermost conical cavity has a forward opening that terminates and attaches at a lower end of said casing;

(c) a two-part binary explosive material comprising a fuel material and a powder material wherein said fuel and powder materials are substantially non-explosive when apart, but when admixed, produce an explosive material;

(d) said powder material placed in the space between said casing and said liner;

(e) said powder material adapted to receive said fuel material via a plurality of penetrative fuel mixing cavities formed within said powder material, wherein said penetrative fuel mixing cavities are adapted to distribute said fuel material within the body of said powder material;

(f) a removable cap formed to close an upper end of said casing, and including a cap opening adapted to receive a detonation cord.

2. The shaped charge device of claim 1, wherein said liner forms two conical cavities having a set of different wall angles, wherein each said wall angles are formed within a range of between 5 and 90 degrees.

3. The shaped charge device of claim 2, wherein said successive wall angles are 10 and 60 degrees.

4. The shaped charge device of claim 1, wherein said liner forms three conical cavities having a set of different wall angles, wherein each said wall angles are formed within a range between 5 and 90 degrees.

5. The shaped charge device of claim 4, wherein said successive wall angles are 5, 10, and 60 degrees.

6. The shaped charge device of claim 1, wherein said cap opening includes an inwardly extending protuberance adapted to guide the detonation cord to a predetermined location upon an upper surface of the said powder material.

7. The shaped charge device of claim 1, wherein said casing includes an attachment means adapted to secure said shaped charge device to a surface of a material to be penetrated.

8. The shaped charge device of claim 7, wherein said attachment means can be chosen from a list of attachment means including a plurality of attachment extensions, self-adhesives, adhesive extensions, attached straps, and hook and latch mechanisms.

9. The shaped charge device of claim 1, further including a bottom plate member securely attached to an end of said casing opposite said upper end.

10. The shaped charge device of claim 9, wherein said bottom plate includes an attachment means adapted to secure said shaped charge device to a surface of a material to be penetrated.

11. The shaped charge device of claim 10, wherein said attachment means can be chosen from a list of attachment means including a plurality of attachment extensions, self-adhesives, adhesive extensions, attached straps, and hook and latch mechanisms.

12. The shaped charge device of claim 1, wherein said liner is formed from a material chosen from a list of materials that can form a thin and rigid member, said list including PVC, CPVC, Polyesters, Polyamids, Phenolics, Amino resins, Acrylics, Acetals, and HDPE.

13. The shaped charge device of claim 1, wherein said casing is formed from a material chosen from a list of materials that can form a thin and rigid member, said list including PVC, CPVC, Polyesters, Polyamids, Phenolics, Amino resins, Acrylics, Acetals, and HDPE.

14. The shaped charge device of claim 1, wherein said powder material is comprised of an ammonium perchlorate powder, wherein said fuel material is a nitromethane fuel, and wherein the ratio of ammonium perchlorate powder to nitromethane fuel is within the range of 79% to 82% and 21% to 18% respectively, by total weight.

15. The shaped charge device of claim 1, further including the detonation cord.

16. The shaped charge device of claim 7 wherein said detonation cord is 18-grain type detonation cord.

17. A method of forming a shaped charge device including the steps of:

(a) placing a liner within a casing to form a plurality of forwardly opening conical cavities within said casing, and thereby forming a space between said liner and an inner wall of said casing, wherein said conical cavities are in linear axial alignment of one another, to thereby form concentric plasma jets, wherein the uppermost conical cavity has a closed apex near an upper end of said casing and the lowermost conical cavity has a forward opening that terminates and attaches at a lower end of said casing;

(b) filling said space with a powder material, wherein powder material is a component of a two-part binary explosive comprising a fuel material and said powder material whereby said fuel and powder materials are substantially non-explosive when apart, but when admixed, produce an explosive material;

(c) compressing and evenly distributing the powder material throughout the volume of the said space with a loading means;

(d) forming a plurality of fuel distributing cavities within said powder material;

(e) using a heat producing means to appropriately harden said powder material;

(f) placing a cap upon an end of said casing that is opposite from an opening formed by said conical shapes, said cap including an opening adapted to receive a detonation cord;

(g) storing the shaped charge device until ready for use;

(f) removing the cap;

(h) filling said fuel distributing cavities with a predetermined amount of said fuel material;

(i) replacing said cap onto said casing;

(j) inserting said detonation cord through the opening in said cap.

* * * * *